US008180255B2

(12) United States Patent
Watanabe

(10) Patent No.: US 8,180,255 B2
(45) Date of Patent: May 15, 2012

(54) ROTATION MEMBER UNIT AND IMAGE FORMING APPARATUS

(75) Inventor: Mutsuo Watanabe, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 805 days.

(21) Appl. No.: 12/200,345

(22) Filed: Aug. 28, 2008

(65) Prior Publication Data

US 2009/0060596 A1 Mar. 5, 2009

(30) Foreign Application Priority Data

Aug. 30, 2007 (JP) ..... 2007-223815

(51) Int. Cl.
*G03G 15/02* (2006.01)

(52) U.S. Cl. ..... 399/167; 399/13

(58) Field of Classification Search ..... 399/167
See application file for complete search history.

(56) References Cited

U.S. PATENT DOCUMENTS

| | | | | |
|---|---|---|---|---|
| 6,157,799 | A * | 12/2000 | Asakura et al. | 399/167 |
| 2002/0114642 | A1 * | 8/2002 | Rimai et al. | 399/167 |
| 2004/0086300 | A1 * | 5/2004 | Kawai et al. | 399/167 |

FOREIGN PATENT DOCUMENTS

| | | |
|---|---|---|
| JP | 2002-311756 | 10/2002 |
| JP | 2004-101825 | 4/2004 |
| JP | 2005-140919 | 6/2005 |

* cited by examiner

*Primary Examiner* — David Gray
*Assistant Examiner* — Roy Y Yi
(74) *Attorney, Agent, or Firm* — Oblon, Spivak, McClelland, Maier & Neustadt, L.L.P.

(57) ABSTRACT

A rotation member unit detachable from a casing includes a rotation member for rotating when driven, and plural drive introduction members arranged at both ends of the rotation member in a rotation axial direction of the rotation member, respectively. The drive introduction member engages with a drive transmission member rotated by a motor.

13 Claims, 6 Drawing Sheets

ROTATION MEMBER UNIT AND IMAGE FORMING APPARATUS

CROSS REFERENCE TO RELATED APPLICATION

This application claims priority under 35 USC §119 to Japanese Patent Application No. 2007-223815, filed on Aug. 30, 2007, the entire contents of which are herein incorporated by reference

BACKGROUND OF THE INVENTION

1. Field of the Invention

The present invention relates to a rotation member unit, such as a photoconductive member, etc., capable of rotating and a drive introduction member secured to at least one end of the rotation member, and in particular to a reusable rotation member unit and an image forming apparatus employing the rotation member.

2. Discussion of the Background Arts

It is known that a rotation member unit includes a rotation member, such as a roller member, etc., and a drive introduction member secured to one end of the rotation member for introducing rotational driving force from a drive transmission member, such as a motor gear, etc., to the rotation member. Especially, an electro-photographic image forming apparatus usually mounts this type of rotation member unit. For example, a photoconductive member unit, which includes a drum shaped photoconductive member, a flange secured to at least one end of the photoconductive member, and a drive introduction gear or a drive introduction coupling integrally arranged with the flange.

In such a rotation member unit, when the drive introduction gear or the drive introduction coupling deteriorates due to wear or the like, the drive introduction member is replaced and the rotation member unit, such as a process cartridge, etc., can be reused as a recycling product.

However, the flange is generally secured to the rotation member firmly by means of engagement, riveting, or adhesion or the like so as not to run idle in relation to the rotation member.

In such a configuration, when a drive introduction member needs to be replaced, since the flange is not easily detached, recycling of the rotation member unit needs a lot of labor or increases cost.

Then, a coupling is inserted or attached to a flange firmly secured to one end of a drum shaped photoconductive member in a rotation axis direction as described in the Japanese Patent Application Laid Open No. 2002-311756. A heat expansion coefficient of such a flange and a coupling is different from each other. Thus, these members can be readily separated by cooling and largely shrinking one of the flange and the coupling in relation to the other.

Further, as described in the Japanese Patent Application Laid Open No. 2004-101825, a photoconductive member unit includes a hole between a flange inserted with a gear into one end of a photoconductive member in an axis direction and an internal periphery of the photoconductive member, and fluid is inserted and injected through the hole. Such a gear flange forming a drive introduction gear and serves as a drive introduction member is either adhered to the inner periphery of the photoconductive member or pressure inserted into the photoconductive member via an elastic member. Thus, when the fluid (or powder) is injected through the hole between the photoconductive member inner periphery and an insertion position to which the gear flange is inserted, the photoconductive member and the gear flange adhering to each other can be readily separated. Otherwise, the gear flange pressure inserted into the photoconductive member can be readily separated from the photoconductive member by deformation of the elastic member caused by injection of the liquid (or powder).

Further, as described in the Japanese Patent Application Laid Open No. 2005-140919, a photoconductive member unit includes an engagement section for engaging a particular kind of separation use jig on a gear flange inserted or adhered to one end of a photoconductive member in a direction of a rotation axis. In such a configuration, the gear flange can be readily withdrawn from the photoconductive member using the separation use jig. However, in anyone of the above-mentioned photoconductive member units, when the coupling is withdrawn from the flange, or the gear flange is withdrawn from the photoconductive member, strong pressure needs to be applied to the photoconductive member via a holding section, and accordingly, the photoconductive member is possibly cut or damaged. Because, the photoconductive member is firmly held.

Especially, the photoconductive member of the Japanese Patent Application Laid Open No. 2005-140919 tends to be cut, because the large pressure is applied to a holding section of the photoconductive member when a gear flange is forcibly withdrawn from the photoconductive member by the separation use jig, because the gear flange is adhered to the photoconductive member by adhesion.

Further, the photoconductive member unit of the Japanese Patent Application Laid Open No. 2002-311756 needs expensive equipment due to necessity of a cooling device for cooling the flange or the coupling. Further, labor, and accordingly, a cost increase, because the flange or the coupling needs to be cooled until a sufficient shrinking effect is obtained.

Further, the photoconductive member unit of the Japanese Patent Application Laid Open No. 2004-101825 needs the injection device equipment therefore and is expensive.

SUMMARY OF THE INVENTION

Accordingly, an object of the present invention is to improve such background arts technologies and provides a new and novel rotation member unit. Such a new and novel rotation member unit is detachable from a casing and includes a rotation member for rotating when driven, and plural drive introduction members arranged at both ends of the rotation member in a rotation axial direction of the rotation member, respectively. The drive introduction member engages with a drive transmission member rotated by a motor.

In another embodiment, the plural drive introduction members have substantially the same shape and size.

In yet another embodiment, the plural drive introduction members include identification elements configured to identify the drive introduction members, respectively.

BRIEF DESCRIPTION ON DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
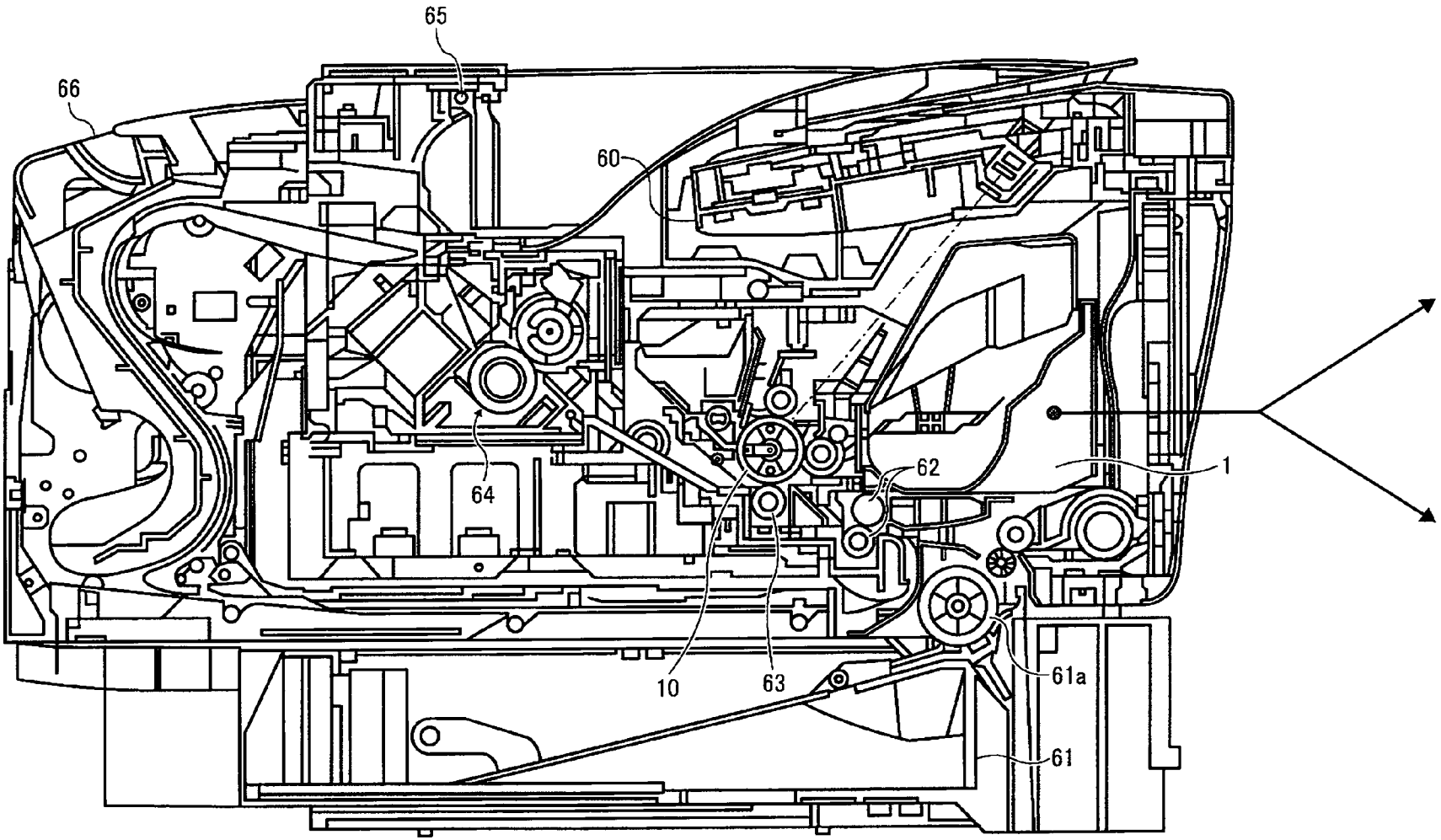
FIG. 1 illustrates an exemplary configuration of a printer according to one embodiment of the present invention.

Referring now to the drawing, wherein like reference numerals designate identical or corresponding parts throughout several views in particular in FIG. 1, a fundamental configuration of an exemplary electro-photographic laser printer as an image forming apparatus is described. As shown, the printer includes a process unit 1 for forming a toner image. Also included are a optical write units 60, a sheet feeding cassette 61, a pair of registration rollers 62, a transfer roller 63, a fixing device 64, an ejection roller 65, and a switchback unit 66, or the like.

The optical write unit 60 serves as a latent image write device and includes a light source having a laser diode, a regular hexahedron polygon mirror, a polygon mirror motor for rotating the regular hexahedron polygon mirror, a f-theta lens, lenses, and a reflection mirror or the like. A laser light L emitted from the laser diode is deviated by the polygon mirror and reaches a surface of a photoconductive member in the dark as mentioned later.

Figure 2:
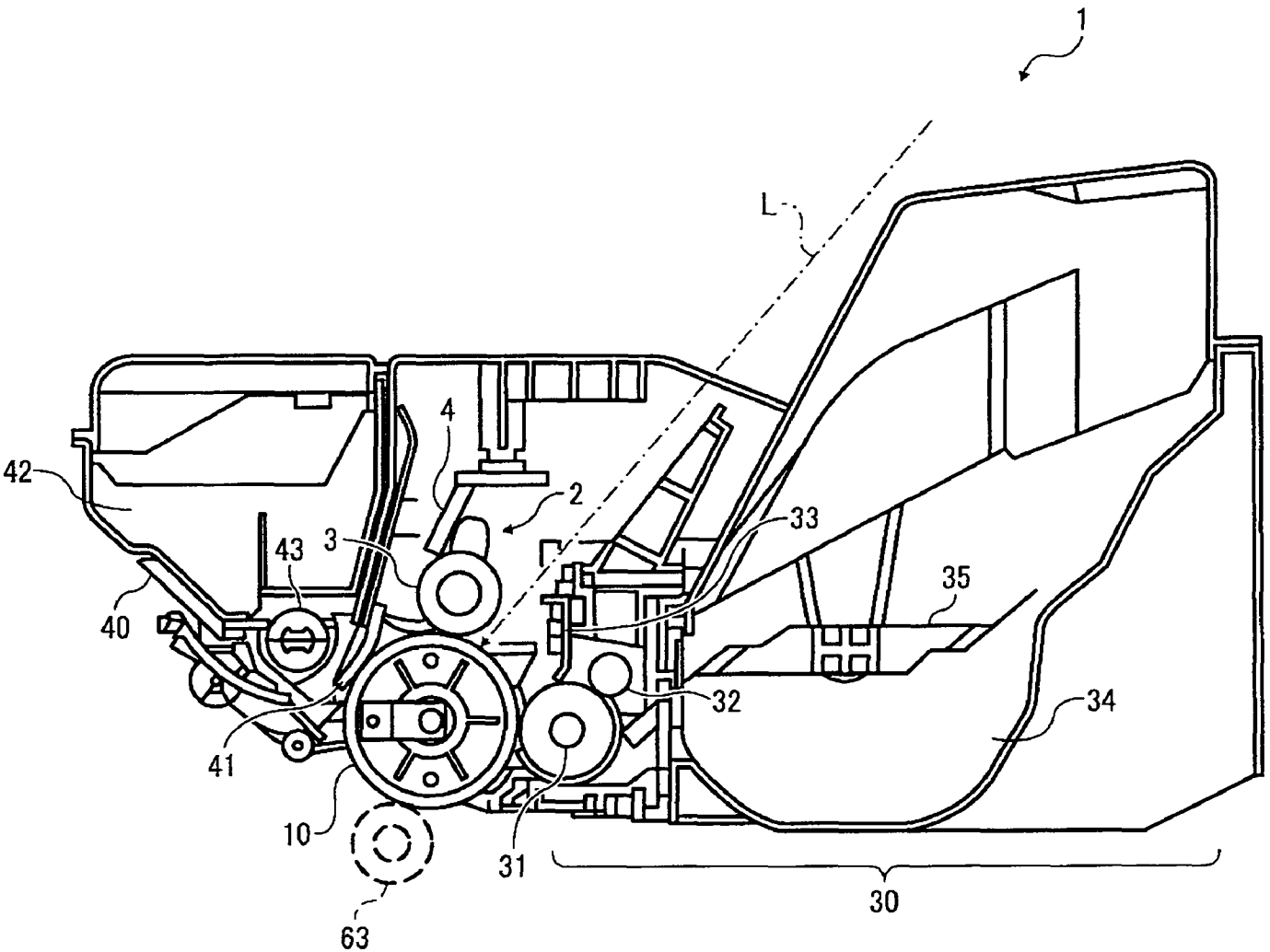
FIG. 2 is an enlarged view illustrating an exemplary process unit included in the printer of FIG. 1.

FIG. 2 illustrates an exemplary process unit 1. As shown, the process unit 1 includes a photoconductive member unit 10 serving as a latent image carrier unit, a charge device 2, a developing device, a drum cleaner device 40, and the like, each arranged around the photoconductive member unit 10. These devices constitute one unit and are commonly held by a casing (i.e., a holder) and are integrally detachable to the printer.

The photoconductive member unit 10 includes a drum shaped photoconductive member as described later, and plural gear flanges secured to the photoconductive member at both ends thereof, and the like.

When the surface of the photoconductive member is uniformly charged and then receives optical scanning in the dark, a potential decreases at an optical irradiated section so that the photoconductive member carries a latent image.

The charging device 2 includes a charging roller 3 rotated while contacting the surface of the photoconductive member of, a roller cleaning blade 4 contacting the charging roller 3, and a power source for applying a charging bias to the charging roller 3, or the like. Then, When the surface of the photoconductive member is discharged by the charging roller 3 opposing the photoconductive member under the charge bias, the surface of the photoconductive member is uniformly charged in a minus polarity as same as a normal charge polarity of toner.

The charging roller 3 sometimes attracts toner, but the toner is removed from the surface of the charging roller 3 by the roller-cleaning blade 4.

A charging brush or a scorotron type-charging device 2 can be employed for the charging roller 3.

A latent image is formed when the optical write unit 60 optically scans the surface of the photoconductive member, which is uniformly charged by the charging device 2. The latent image is then developed by the developing device 30 to be a toner image.

The developing device 30 includes a developing roller 31 driven rotated while partially being exposed from an opening arranged at one end of the casing. The developing device 30 also includes a toner supplying roller 32 rotated contacting the developing roller 31, a thin layer forming blade 33, and a toner container 34 or the like.

The toner container 34 contains toner not shown. The toner is conveyed toward a toner-supplying roller 32 by an agitator 35 freely rotatively arranged in the toner container 34 when rotated.

The toner-supplying roller 32 includes a core metal and a toner carrier layer having form material, such as foam urethane, etc., wrapping the core metal, and is rotated by a drive device, not shown. After taking in the toner conveyed by the agitator 35 into a form cell included in the toner carrying layer, the toner supplying roller 32 supplies the toner to the surface of the developing roller 31 at a positing contacting the developing roller 31.

The developing roller 31 also includes a core metal and an elastic layer wrapping the core metal, and is driven rotated counterclockwise by a driving device, not shown, while being supported by a bearing, not shown. Then, developing roller 31 carries the toner supplied from the toner-supplying roller 32 on the surface of the elastic layer. Thus, the toner layer formed on the surface of the developing roller 31 enters the contact section in which the thin layer blade 33 contacts the developing roller 31, as the developing roller 31 rotates. After the toner roller is thinned and flattened by the thinning blade 33 and toner particle is increasingly charged by friction, the toner layer is conveyed to a developing region where the developing roller 31 contacts the photoconductive member.

The developing roller 31 receives a developing bias from a power supply, not shown. The developing bias includes a direct current voltage of a minus polarity or a superimposed voltage obtained by superimposing a minus polarity of direct current voltage and an alternating current voltage. In anyway, the direct current voltage has the minus polarity, an absolute value of which is larger than a minus polarity of a latent image on a photoconductive member. The absolute value of the minus polarity is smaller than that of a background (i.e., a uniformly charged portion) of the photoconductive member. In the developing region, toner charged with the minus polarity is transferred to the latent image on the photoconductive member. Thus, the latent image is developed to be a toner image.

The toner image developed in this way is conveyed toward a transfer nip in which the photoconductive member contacts the transfer roller 63 arranged on the printer body side as the photoconductive member rotates, thereby being transferred on to a recording sheet, not shown.

The developing device can employ a two component developing system using two component developer mainly having toner and magnetic carrier instead of the above-mentioned one component developing system using one component developer excluding the magnetic carrier.

Toner not transferred onto the recording sheet remains sticking to the surface of the photoconductive member downstream of the transfer nip as the photoconductive member rotates. Such toner is removed by a drum-cleaning device 40 from the photoconductive member.

The drum cleaning device 40 includes a cleaning blade 41 serving as a toner removing device that contacts the surface of the photoconductive member upstream of a charging position, in which the charging roller 3 contacts the photoconductive member and downstream of the transfer nip. Thus, the cleaning blade 41 scrapes post transfer toner off the photoconductive member. Also included are a used toner container 42 that contains the post transfer toner being scraped off, and a conveyance rotation member 43 for conveying the post transfer toner just after being scraped off to the used toner container 42.

After the post transfer toner is cleaned by the drum cleaning device 40, the surface of the photoconductive member is subjected to a charge removing process executed by a charging removing lamp, not shown, and is then uniformly charged again by the charging device 2.

The above-mentioned process unit 1 is withdrawn from the printer and is replaced with a new when toner in the toner container 34 is used up. The used up process unit 1 can be collected by a reproduction trader to reproduce the same. The reproduction trader disassembles the used up process unit 1 and inspects a deterioration level of various parts. The reproduction trader then replaces old parts with a new or cleans the parts upon need. After reassembling and replenishing toner into the toner container 34, a reproduction process unit is shipped.

Referring back to FIG. 1, the core metal of the transfer roller 63 contacts the photoconductive member of the photoconductive member unit 10 and forms a transfer nip while receiving a transfer bias from a transfer bias applying device, which is formed from a power supply or the like, not shown. Thus, a transfer electric field is formed between the transfer roller 63 and a latent image on the photoconductive member. A brush or blade type transfer device or a transfer charger can be employed to create the transfer electric field instead of the transfer roller 63.

In the lower section of the printer, a sheet cassette 61 is arranged. The sheet cassette 61 accommodates a stack of plural recording sheets in a bundle state, on the top of which a sheet feeding roller 61*a* pressure contacts. The sheet feeding roller 61a rotates and launches the recording sheet at a prescribed time.

On a sheet-feeding path, a pair of registration rollers 62 contacting each other is arranged and is rotated to pinch the recording sheet fed from the sheet cassette 61 between the rollers. The rollers stops rotating when pinching the leading end of the recording sheet P therebetween. The rollers 62 restarts rotating and feeds the recording sheet toward the transfer nip in synchronism with a toner image on the photoconductive member.

The recording sheet launched from the transfer nip is conveyed to a fixing device. In the fixing device, a fixing roller includes a heat source, such as a halogen lamp, etc., and contacts a pressure-applying roller so that a nip is created therebetween. The recording sheet transferred from the transfer nip is pinched at the fixing nip. Then, the toner image is fixed onto the recording sheet with heat and pressure at the nip.

In this way, the recording sheet undergone the fixing process is launched from the fixing device 64 and advances to a bifurcation to a sheet ejection path and a switchback path. A switching pick, not shown, capable of swinging is arranged at the bifurcation, and a conveyance path for the recording sheet is switched either to a sheet ejection path or a switch back path in accordance with a swinging stop position of the pick. When the switching pick selects the sheet ejection path, the recording sheet passes through the sheet ejection path and is ejected by a sheet ejection roller 65 to an outside. Whereas when the switching pick selects the switchback path, the recording sheet is conveyed to the switch back path 66. The recording sheet then is fed again by the registration roller pair 62 while being reversed upside down (front and rear sides), so that a toner image is transferred onto the backside of the recording sheet at the transfer nip. Then, the recording sheet passes through the fixing device 64 again and is ejected to the outside via the sheet ejection path.

Figure 10:
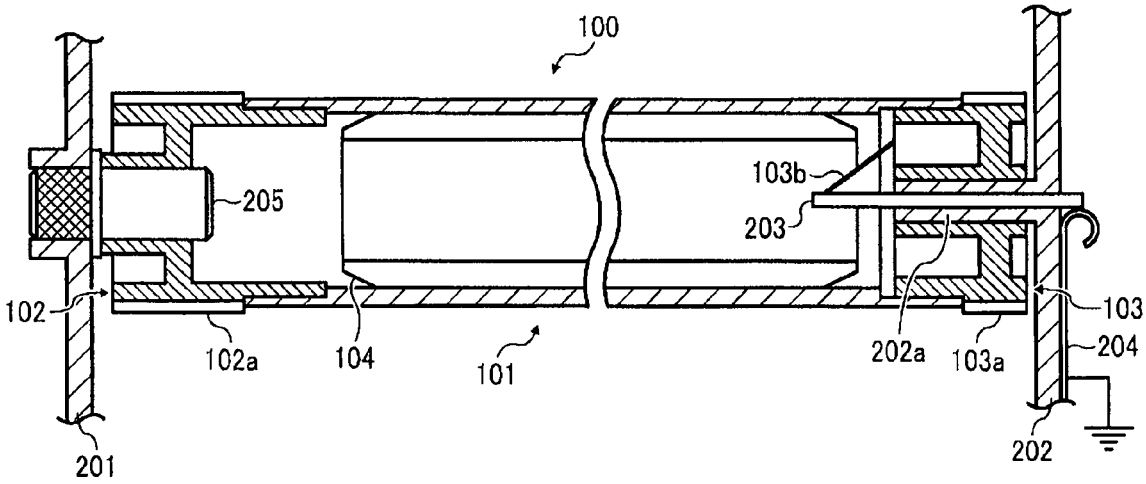
FIG. 10 is an enlarged view illustrating a conventional photoconductive member unit together with a side plate of a casing of a process unit.

Now, a photoconductive member unit of a related image forming apparatus is described together with a casing of a process unit with reference to FIG. 10. A shown, a photoconductive member unit 100 includes a hollow drum type photoconductive member 101, a drive introduction gear flange 102 pressure inserted into one end of the photoconductive member 101 in a rotation axis direction of the photoconductive member 101, and a cleaning drive gear 103 also pressure inserted into another end of the photoconductive member 101.

The photoconductive member 101 includes a drum shaped bare tube made of aluminum or the like wrapped by an organic photoconductive layer. In the hollow of the photoconductive member 101, a vibration-suppressing member 104 made of an elastic member having a hollow structure is pressure adhered so as to suppress vibration of the photoconductive member.

The drive introduction gear flange 102 made of polyacetal resin or the like is pressure adhered to the photoconductive member 101 as a drive introduction member and thereby being rotated together with the photoconductive member 101. By meshing a drive introduction gear 102*a* formed on the own rotational periphery of the drive introduction gear flange 102 with a motor gear serving as a drive transmission gear, not shown, secured to the printer, the drive introduction gear flange 102 can receive a rotational driving force therefrom. As a result, the rotation drive force of the motor gear is transmitted to the photoconductive member unit 100, so that the photoconductive member unit 100 is rotated.

At a rotational center of the drive introduction gear flange 102, a slide bearing portion having a penetration hole is formed in a rotational axis direction. On a left side plate 201 of the process unit, a securing shaft member 205 having a cylindrical shape is secured at one end, and protrudes into the process unit 100. By inserting the securing shaft member 205 into the slide bearing section of the drive introduction gear flange 102, the left side end of the photoconductive member unit 100 is freely rotatively supported.

The cleaning drive gear flange 103 serves as a drive output member and is pressure inserted into the photoconductive member 101, thereby being capable of rotating together with the photoconductive member 101. A drive output gear 103*a* is formed on the rotational periphery of the gear flange 103, and is meshed with a toner collection conveyance gear, not shown, included in the process unit. The toner collection gear is secured to a rotation shaft of the conveyance rotation member 43 included in the cleaning device 40, and rotates the conveyance rotation member upon receiving rotational drive force from the drive output gear 103*a*. Thus, post transfer toner scraped off the photoconductive member 101 is transferred to the used toner container 42 of FIG. 2.

The cleaning drive gear flange 103 is made of polyacetal resin or the like and includes a small friction coefficient. The cleaning drive gear flange 102 also includes a slide bearing section of a circular hole extending in a rotational axis direction at a flange rotation center. On the right side plate of the casing of the process unit 100, an electrode shaft 202*a* made of metal having a cylindrical shape is provided to protrude into the process unit 100. Due to insertion of the electrode shaft 202*a* into the circular hole of the slide bearing section of the cleaning drive gear flange 103, the right side end of the photoconductive member unit 100 is freely rotatively supported.

A leading end 203 of the shaft member 202*a* enters the process unit 100. The other end of the electrode shaft 202*a* protrudes to the outside of the right side plate 202. An earth electrode 204 is secured to the outside of the right side plate 202 and contacts the protrusion of the electrode bar 203.

To one end of the cleaning drive gear flange 103 on the photoconductive member interior side, an earth plate 103*b* is secured. One end of the earth plate 103*b* contacts an inner periphery of the photoconductive member 101. The other end of the earth plate 103*b* contacts the metal bar 203 protruding from the leading end of the shaft member 202*a*.

As the photoconductive member unit 100 rotates, the earth plate 103*b* rotates, and sliding contacts one end of the stable electrode bar 203. Since the other end of the electrode bar 203 contacts the earth electrode 204 at the outside of the casing, the photoconductive member 101 is grounded via the earth plate 103*b*, the electrode bar 203, and the earth electrode 204 during its rotation.

When the drive introduction gear 102*a* deteriorates due to wear or the like, the drive introduction gear flange 102 pressure inserted into the photoconductive member 101 from the photoconductive member 101 needs to be withdrawn and replace it with a new in order to reproduce the process unit 100. Thus, there have been chances of damaging the photoconductive member 101 during withdrawal and labor and a particular kind of equipment are needed for a withdrawing operation.

Figure 3:
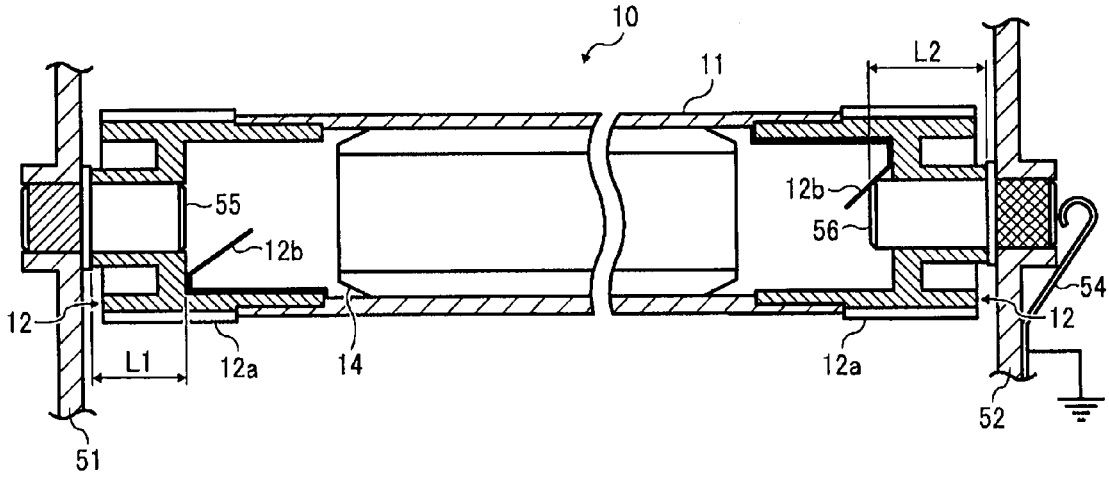
FIG. 3 is an enlarged view illustrating a photoconductive member unit mounted on the process unit of FIG. 1 together with a side plate of the process unit.

Now, an exemplary unique configuration of the printer of one embodiment of the present invention is described with reference to FIG. 3, wherein a photoconductive member unit 10 mounted on a process unit and a side plate of the process unit are illustrated. As shown, a photoconductive member unit 10 includes a drum shaped hollow photoconductive member 11, a pair of drive introduction gear flanges 12 pressure inserted into both ends of a photoconductive member 11 in a rotational axis direction of the photoconductive member 11, respectively. These two-drive introduction gear flanges 102 have substantially the same shape and size (i.e., the same parts).

The photoconductive member 11 includes a drum state bear tube made of aluminum or the like coated with an organic photoconductive layer. In the hollow of the photoconductive member 11, a vibration-suppressing member 14 including an elastic member also having a hollow structure is pressure adhered so as to suppress vibration of the photoconductive member 11. A motor gear, not shown, secured to the printer meshes with a drive introduction gear 12*a* secured to a drive introduction gear flange 12 made of polyacetal resin or the like positioned at the left side in the drawing among two drive introduction gear flanges 12.

At the rotational center of the drive introduction gear flange 12, a slide bearing section having a circular shape penetrating in a rotational axis direction is formed. To the inner surface of the left side plate 51 of the casing of the process unit 10, a cylindrical left side securing shaft member 55 made of metal is secured so as to protrude from the inner surface of the side plate into the process unit 10. By inserting the left side securing shaft member 55 into the slide bearing section of the left side drive introduction gear flange 12, the left side end of the photoconductive member unit 10 is freely rotatively supported. Further, a right side securing shaft member 56 made of metal is cylindrical and is secured to the inner surface of the right side plate 54 of the casing of the process unit 10 so as to protrude from the inner surface of the side plate 54 into the process unit 10. By inserting the right side securing shaft member 56 into the slide bearing section of the right side drive introduction gear flange 12, the right side end of the photoconductive member unit 10 is freely rotatively supported.

These two drive introduction gear flanges 12 include the earth plates 12*b* secured to the hollows, respectively, and each one end of the earth plate 12*b* contacts the inner periphery of the photoconductive member 11.

The left side securing shaft member 55 and the right side securing shaft member 56 have substantially the same diameter. Thus, these can appropriately engage with the two slide bearings of the drive introduction gear flanges 12 having the same shape and size, respectively. However, a length in an axis direction can be different from each other. Specifically, a length L2 of the right fixed shaft member 56 is larger than that of L1 of the left side securing shaft member 55. Thus, in the right side drive introduction gear flange 12, the leading end of the right side securing shaft member 56 reaches and contacts the earth plate 12*b* in the flange.

Whereas in the left side drive introduction gear flange 12, the leading end of the left side securing shaft member 55 neither reaches nor contacts the earth plate 12*b* in the flange 12. With such a configuration, waist of the earth plate 12*b* caused by slide-contacting the left side securing shaft member 55 can be avoided or suppressed.

However, the earth plate 12*b* of the left side drive introduction gear flange 12 can be arranged to contact the left side securing shaft member 55 while the earth plate 12*b* of the right drive introduction gear flange 12 is arranged not to contact the right side securing shaft member 56.

One end surface of the right side securing shaft member 56 is exposed from the casing. Then, the earth electrode 54 secured to the outer surface of the right side plate 54 contacts the one end surface. Thus, the photoconductive member 11 is grounded via the earth plate 12*b* of the drive introduction gear flange 12 of the right side in the drawing and the earth electrode 54 during its rotation.

The drive introduction gear 12*a* of the left side drive introduction gear flange 12 meshes with a motor gear, not shown, secured to the printer, thereby receiving rotational driving force. When the drive introduction gear 12*a* deteriorates due to friction or the like, the photoconductive member unit 11 is withdrawn from the process unit 10. The photoconductive member unit 11 is reversed left and right so that attaching positions thereof in relation to the process unit 10 can be reversed. As a result, the drive introduction gear 12*a* of the right side drive introduction gear flange 12, previously disengaged with the motor gear of the printer body, comes to engage with the motor gear. Thus, a process unit is substantially reproduced without replacing the drive introduction gear flange 12 of the process unit.

By meshing with a motor gear, not shown, separately from the drive introduction gear 12, driving force transmission to the conveyance rotation member 43 is achieved. However, the gear of the conveyance rotation member 43 or a relay gear meshing with the conveyance rotation member 43 can be meshed with the drive introduction gear 12*a* beside the motor gear.

Figure 4:
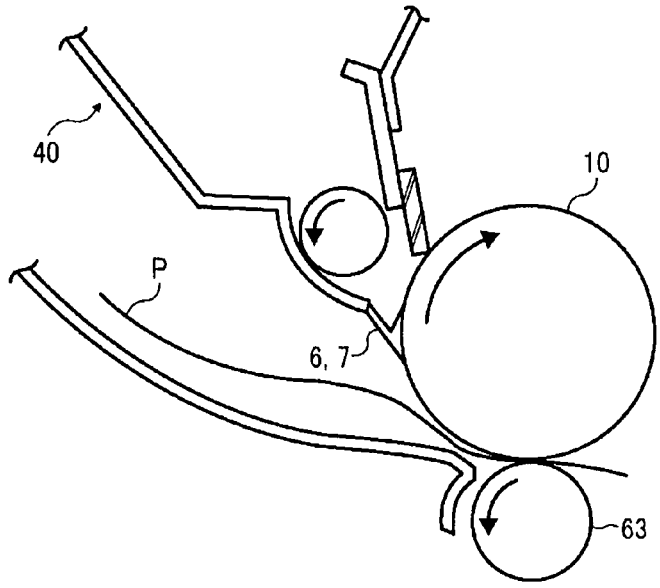
FIG. 4 is a partial view illustrating a photoconductive member unit mounted on the process unit together with a peripheral configuration according to one embodiment of the present invention.

Hereinbelow, an exemplary unique printer is described according to one embodiment of the present invention with reference to FIG. 4, which partially illustrates a photoconductive member unit 10 included in the process unit together with peripheral devices. As shown, a recording sheet P passing through a transfer nip formed between a transfer roller 63 and a photoconductive member of the photoconductive member unit 10 is forcibly separated from the surface of the photoconductive member by first and second separation picks 6 and 7 contacting the photoconductive member. Thus, a jam of the recording sheet P caused when the recording sheet P winds up the photoconductive member after passing through the transfer nip can be avoided or suppressed. The first separation pick 6 partially contacts the photoconductive member only at one end in the axis direction of the photoconductive member, whereas the second separation pick 7 contacts the other end thereof.

Figure 5:
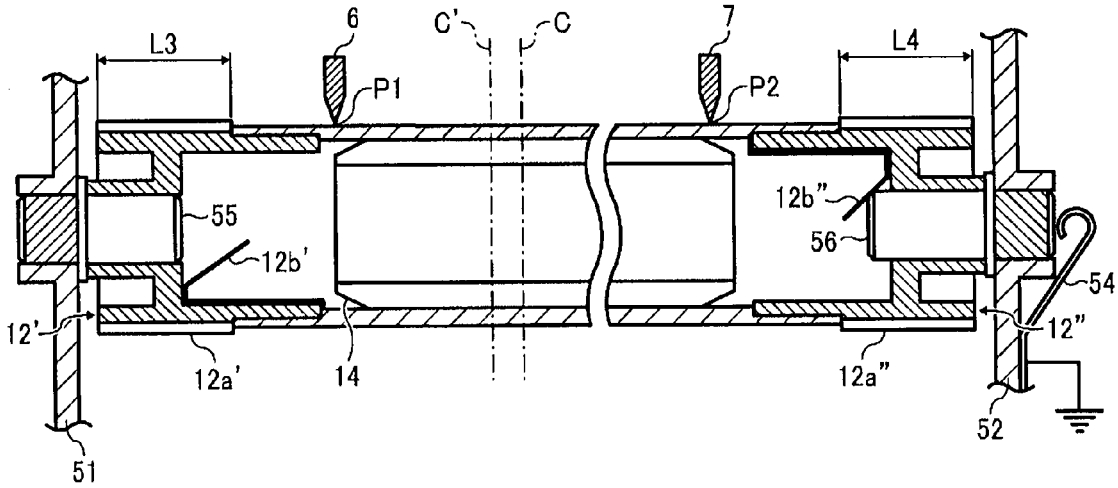
FIG. 5 is an enlarged view illustrating the photoconductive member unit.

FIG. 5 is an enlarged view illustrating the photoconductive member unit 10 according to another embodiment of the present invention. In this photoconductive member unit 10, the drive introduction gear flanges 12' and 12" are secured to both ends of the photoconductive member 11, respectively. However, the size of these drive introduction gear flanges 12' and 12" is different from the other. Specifically, the drive introduction gear 12*a*' of the left side first drive introduction gear flange 12' has a length L3 in a rotational axis direction larger than that 12*a*' of L4 of the right side drive introduction gear flange 12".

As shown, when the photoconductive member unit 10 is attached to the process unit while the first drive introduction gear flange 12' is positioned at the left side in the drawing, the center of the photoconductive member 11 in the rotational axis direction is positioned at a section as shown by a dotted line C. Where as when the photoconductive member unit 10 is reversed left and right, specifically, the first drive introduction gear flange 12' is positioned at the right side in the drawing, the center of the photoconductive member 11 moves from the dotted line C to that of C'. This is because, the length of the drive introduction gear 12*a*' of the first drive introduction gear flange 12' is different from that 12*a*" of the second drive introduction gear 12*a*".

When the photoconductive member unit 10 is reversed left and right from the state as shown in the drawing, a contact position of each of the separation picks is changed in relation to the photoconductive member 11. Specifically, the first separation pick 6 contacts a position P1 on the photoconductive member 11, whereas the second separation pick 7 contacts a position P2 on the photoconductive member 11. When the length of the drive introduction gears 12*a*' and 12*a*" are the same, and the photoconductive member unit 10 is reversed left and right, the first separation pick 6 contacts the position P2, whereas the second separation pick 7 contacts the position P1.

Thus, even when the photoconductive member unit 10 is reversed, the separation picks can contact the same positions as before. In contrast, when the photoconductive member unit 10 reversed, the first and second separation picks 6 and 7 can contact different positions from those of P1 and P2.

By controlling each of the separation picks to contact a different position on the photoconductive member from that of before, quick deterioration of the photoconductive member caused when the separation picks keep contacting the same positions can be avoided.

Figure 6:
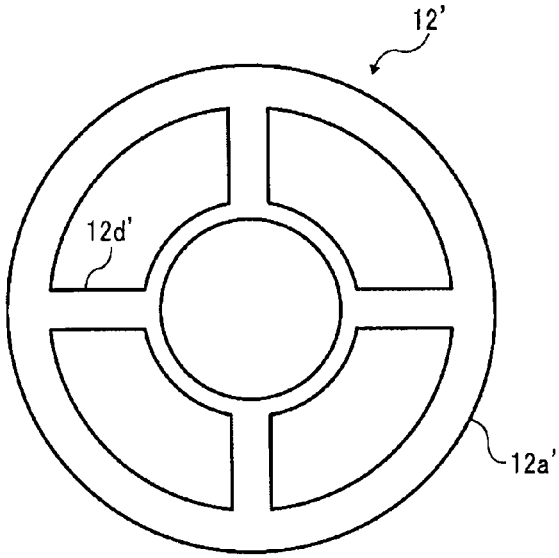
FIG. 6 is a front view illustrating an exemplary first drive introduction gear flange when viewed from one end in an axis direction (from a side not secured)

FIG. 6 is a front view illustrating an exemplary first drive introduction gear flange 12' when viewed from one end thereof in an axis direction (i.e., a not secured side). The drive introduction gear 12*a*' has a double hollow structure. That is, a first hollow is arranged inside most and serves as a slide bearing for receiving a securing shaft member arranged on the side plate of the process unit. To constitute the slide bearing, a first cylindrical wall is formed at a center of the drive introduction gear 12*a*'. A second hollow is formed between the first cylindrical wall and a second cylindrical wall of the drive introduction gear 12*a*' having plural gears at its outer surface. To reinforce these cylindrical walls, four ribs 12*d*' are radially arranged so as to connect the walls.

Figure 7:
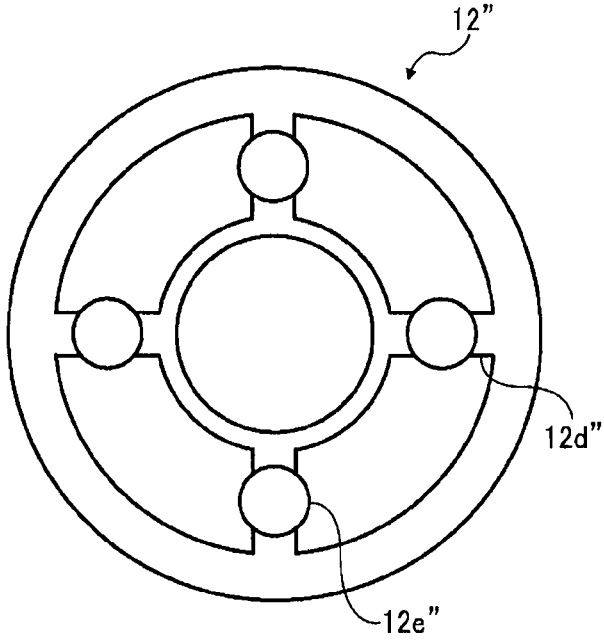
FIG. 7 is a front view illustrating an exemplary second drive introduction gear flange when viewed from one end in an axis direction (from a side not secured)

FIG. 7 is a front view illustrating an exemplary second drive introduction gear flange 12" when viewed from one end thereof in an axis direction (i.e., a not secured side). The second drive introduction gear flange 12" also has a double hollow structure and four ribs 12*d*" arranged so as to connect the first and second cylindrical walls. However, a protrusion 12*e*" protruding from one end thereof in the axis direction can be integrally formed on each of the ribs 12*a*".

Thus, based on presence or absence of the protrusion 12*e*" serves as an identification device, and accordingly, each of the first and second drive introduction gear flanges 12' and 12" can readily be identified by sight or a sense of touch. Thus, when these flanges are identified and a positional relation therebetween is confirmed, it is readily recognized if the process unit is already reproduce or is not yet reproduced.

Figure 8:
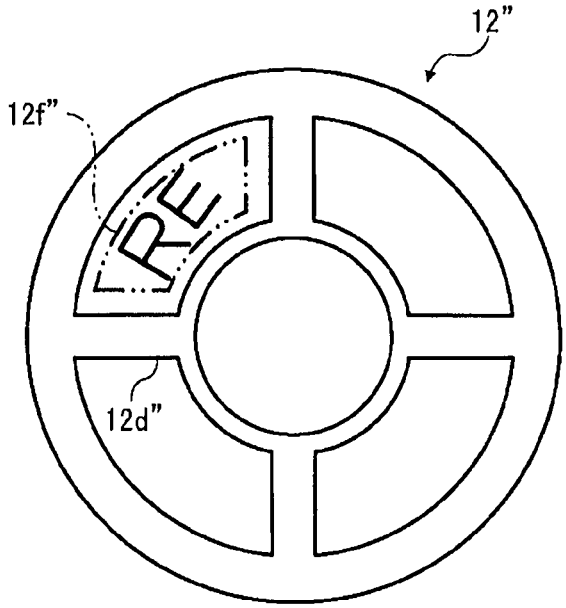
FIG. 8 is a front view illustrating a first modification of the second drive introduction gear flange.

Now a first modification is described with reference to FIG. 8, wherein a first an exemplary second drive introduction gear flange 12" is illustrated. As shown, a character mark 12*f*" is formed within the hollow of the second drive introduction gear flange 12" while indicating the letter "RE" as an identification mark visually capable of reading. The character mark 12*f*" can be formed from protrusion or grooves. In contrast, the first drive introduction gear flange 12' does not include such a protrusion or a groove, or includes a different character mark from the second drive introduction gear flange 12. Thus, in accordance with the presence of the character mark or the difference, the first and second drive introduction gear flanges 12' and 12" can be identified.

When the size of the these drive introduction gear flanges 12' and 12" is not differentiated from the other, the same flanges are molded using the same mold while differentiating a character mark by using a nest detachably arranged in the mold.

Further, as an identification device for identifying respective drive introduction gear flanges 12' and 12", different color material, a label, and a print or the like can be employed.

Figure 9:
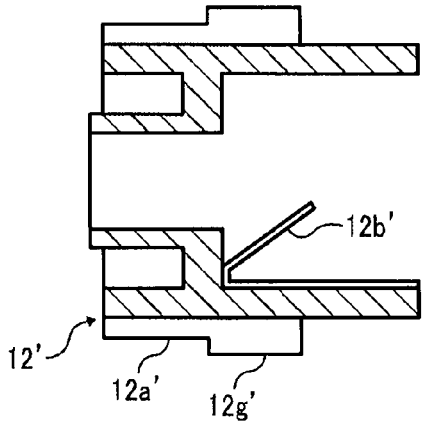
FIG. 9 is an enlarged view illustrating a second modification of the first drive introduction gear flange.

Now still a second modification is described with reference to FIG. 9, wherein an exemplary first drive introduction gear flange 12' is illustrated. As shown, the first drive introduction gear flange 12' integrally includes a drive introduction gear 12*a*' for receiving a rotational driving force from a motor gear with a drive outputting gear 12*g*' for outputting the rotational force to a conveyance rotation member 43 of FIG. 2, not shown, arranged side by side in a axis direction. The drive output gear 12*g*' meshes with a gear secured to the conveyance rotation member or a relay gear meshing with the conveyance rotation member gear, thereby outputting the rotational driving force to the conveyance rotation member of the drum cleaning device 40 of FIG. 2.

Similar to the first drive introduction gear flange 12', the second drive introduction gear flange, not shown, integrally includes a drive introduction gear with a drive output gear. However, the length of the drive introduction gear and the drive output gear can be different from the other in the first drive introduction gear flange 12'.

The present invention can be applied to a rotation member unit, such as a developing roller, etc., beside the above-mentioned photoconductive member unit.

In the printer of this embodiment, since the drive introduction gear 12*a* has substantially the same shape and size as the drive introduction gear 12*a*, the same parts molded from the same mold can be used.

Further, in the first modification of the printer, since the protrusion or the character mark is arranged on one of the drive introduction gears 12*a*' of the first and second drive introduction gear flanges 12' and 12", it is readily recognized by confirming a positional relation of both of the flanges whether the process unit has already been reproduced or not yet reproduced by reversing the photoconductive member unit 10.

Further, the protrusion protruding from the end surface of the drive introduction gear 12*a*" in the rotational axis direction is employed, the flanges can be readily identified by a sense of touch.

In the first modification, since the visually readable character mark 12*f*" is used as identification, the both of the flanges can be readily identified.

Obviously, numerous additional modifications and variations of the present invention are possible in light of the above teachings. It is therefore to be understood that within the scope of the appended claims, the present invention may be practiced otherwise than as specifically described herein.

What is claimed is:

1. A rotation member unit detachable from a casing, comprising:

a rotation member configured to rotate when driven, said rotation member being contacted by at least one separator secured to the casing;

at least two drive introduction members arranged at both ends of the rotation member in a rotational axis direction of the rotation member, respectively, one of said drive introduction members engaging with a drive transmission member rotated by a motor;

a first grounding plate secured to a first of said drive introduction members and electrically connecting to an inner periphery of the rotation member; and a second grounding plate secured to a second of said drive introduction members and electrically connecting to an inner periphery of the rotation member, wherein only one of the first grounding plate or the second grounding plate makes contact with an electrode shaft passing through a respective drive introduction member in the rotational axis direction, to ground the rotation member.

2. The rotation member unit as claimed in claim 1, wherein said at least two drive introduction members have substantially the same shape and size.

3. The rotation member unit as claimed in claim 1, wherein said at least two drive introduction members include identification elements configured to identify the drive introduction members, respectively.

4. The rotation member unit as claimed in claim 3, wherein each of said at least two identification elements includes a protrusion protruding from a surface of a respective drive introduction member in the rotational axis direction.

5. The rotation member unit as claimed in claim 3, wherein each of said identification elements includes an identification mark visually readable.

6. The rotation member unit as claimed in claim 1, wherein said at least one separator includes a separator contacting a surface of the rotation member at one end of the rotation member in the rotational axis direction and a separator contacting the surface at an opposing end of the rotation member in the rotational axis direction, and wherein said at least two drive introduction members have a different length in the rotational axis direction from each other.

7. The rotation member unit as claimed in claim 1, further comprising a drive outputting member configured to output driving force of the rotation member to an external device, said drive outputting member being arranged on the rotation member beside one of the drive introduction members.

8. The rotation member unit as claimed in claim 1, wherein said rotation member includes a latent image carrier configured to carry a latent image to be developed.

9. The rotation member unit as claimed in claim 7, wherein said drive outputting member and the at least two drive introduction members are integrally manufactured.

10. An image forming apparatus, comprising:

a motor;

a drive transmission member rotated by the motor;

a rotation member unit detachable from the image forming apparatus and including a rotation member configured to rotate when driven by the drive transmission member, said rotation member being contacted by at least one separator secured to the image forming apparatus;

at least two drive introduction members secured to both ends of the rotation member in a rotational axis direction of the rotation member, respectively, one of said drive introduction members engaging with the drive transmission member when rotation member unit is attached to the image forming apparatus;

a first grounding plate secured to a first of said drive introduction members and electrically connecting to an inner periphery of the rotation member; and a second grounding plate secured to a second of said drive introduction members and electrically connecting to an inner periphery of the rotation member, wherein only one of the first grounding plate or the second grounding plate makes contact with an electrode shaft passing through a respective drive introduction member in the rotational axis direction, to ground the rotation member; and a supporting device configured to support the rotation member unit.

11. The image forming apparatus as claimed in claim 10, wherein said rotation member unit and the supporting device are integrally detachable from the image forming apparatus.

12. The rotation member unit as claimed in claim 1, wherein said rotation member unit is reversible so that only the other one of the first grounding plate or the second grounding plate makes contact with the electrode shaft passing through a respective drive introduction member in the rotational axis direction, to ground the rotation member.

13. The image forming apparatus as claimed in claim 10, wherein said rotation member unit is reversible so that only the other one of the first grounding plate or the second grounding plate makes contact with the electrode shaft passing through a respective drive introduction member in the rotational axis direction, to ground the rotation member.

* * * * *